US006298206B1

(12) United States Patent
Toyoshima et al.

(10) Patent No.: US 6,298,206 B1
(45) Date of Patent: Oct. 2, 2001

(54) ELECTROPHOTOGRAPHIC DEVELOPING APPARATUS

(75) Inventors: Tetsuro Toyoshima, Kyoto; Tadashi Iwamatsu, Nara; Nobuyuki Azuma, Ibaraki; Yoshinori Mutou, Nara; Yoshinori Nakajima, Joyo, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/506,304

(22) Filed: Feb. 17, 2000

(30) Foreign Application Priority Data

Feb. 17, 1999 (JP) ..... P11-039127

(51) Int. Cl.[7] ..... G03G 15/08; G03G 15/24; G03G 15/00

(52) U.S. Cl. ..... 399/253; 399/152; 399/159

(58) Field of Search ..... 399/152, 159, 399/253, 258, 264, 272, 274, 279, 281, 284

(56) References Cited

U.S. PATENT DOCUMENTS 5,587,773 * 12/1996 Yano et al. ..... 399/152
5,887,233 * 3/1999 Abe et al. ..... 399/284
6,049,345 * 4/2000 Nishio et al. ..... 399/284 X

FOREIGN PATENT DOCUMENTS 5-216274 8/1993 (JP) .

* cited by examiner

*Primary Examiner*—Sandra Brase
(74) *Attorney, Agent, or Firm*—Dike Bronstein, Roberts & Cushman IP Group, Edwards & Angell, LLP; David G. Conlin; David A. Tucker

(57) ABSTRACT

It is an object of the invention that development quality is improved by increasing the amount of charge during the transportation of toner by a toner holding member and decreasing the amount of charge during development for rendering an electrostatic latent image visible. A one-component non-magnetic toner is supplied from a toner supplying unit to the toner holding member such that the toner is electrostatically attracted to adhere to the toner holding member with a large amount of charge. The charge of the toner under transportation is reduced by charge adjusting means such as a conductive roller supplied with a potential from a frictional charging member or a voltage source, whereby the amount of development or the amount of toner adhering to an electrostatic latent image is increased and development quality is improved.

7 Claims, 6 Drawing Sheets

ELECTROPHOTOGRAPHIC DEVELOPING APPARATUS

BACKGROUND OF THE INVENTION

1. Field of the Invention

The present invention relates to an electrophotographic developing apparatus, such as a copier, a printer, or a facsimile apparatus, which renders an electrostatic latent image visible by using a toner in an electrophotographic process, and to an electrophotographic apparatus using the same.

2. Description of the Related Art

In a developing apparatus used in an electrophotographic image forming apparatus as an electrophotographic apparatus, toner particles reduced in size improve denseness of an image and reproducibility of extremely small dots, thereby enabling development with high image quality. However, it has been known that the toner particles reduced in size increase a surface area per unit volume, which increases the amount of frictional charging per unit volume or per unit weight, i.e., the specific charge of the toner and lowers developability.

For example, Japanese Unexamined Patent Publication JP-A 5-216274 (1993) discloses a contact development method using a one-component non-magnetic toner having a first surface region and a second surface region such that charging of a specified polarity occurs at the first surface region, while no charging occurs at the second surface region. The use of such a toner prevents an excess increase in the amount of charge even when a particle diameter is reduced. In the prior art technology, however, the composition of the toner is complicated.

When the specific charge of a toner is reduced to increase the amount of development, i.e., the amount of the toner adhering to an electrostatic latent image, an image force is lowered so that the ability to cause the toner to adhere to a toner holding member is reduced. For this reason, there has conventionally been required to coat a toner with a maximized mechanical force or by applying a supply bias voltage between a supply member and the toner holding member and thereby promote the supply of the toner by using such coating means. When a toner having a small particle diameter is coated continuously under mechanical pressure, the toner is more likely to be fixed to the toner holding member, which presents a problem. Normally, the amount of toner used for development corresponds to about two toner layers so that it is sufficient to coat and transport toner in a minimum required amount. If the coating means is used by performing mechanical coating or applying a bias voltage as described above, an excess amount of toner is coated so that a large amount of toner should be removed by using a regulating member. Mere lowering of the specific charge for an increased amount of development is undesirable and disadvantageous in terms of the supply and transportability of the toner.

In supplying toner, if the toner is highly charged one, namely, has a large amount of charge, the needed but minimum amount of the toner can be coated under low stress without the coating means mentioned above by performing mechanical coating or supplying a bias voltage. On the other hand, the amount of the toner consumed in a development region is reduced and the amount of the toner supplied to an electrostatic latent image is reduced, so that the density of image is lowered and the amount of development is thereby reduced. Thus, ease of supply and the amount of development are contradictory to each other.

SUMMARY OF THE INVENTION

It is therefore an object of the invention to provide an electrophotographic developing apparatus capable of providing improved development quality, wherein the amount of charge of toner can be increased during the transportation of the toner and decreased during development, and to an electrophotographic apparatus using the electrophotographic developing apparatus.

The invention provides an electrophotographic developing apparatus comprising:

a toner holding member for electrostatically attracting a toner to rotate and rendering, in a development region, an electrostatic latent image held on a surface of an electrostatic latent image holding member visible by using the toner;

toner supplying means for supplying the toner to the toner holding member; and charge adjusting means disposed between the development region and the toner supplying means for decreasing amount of charge of the toner.

In accordance with the invention, the amount of charge of the toner is increased while the toner is supplied and transported by the toner supplying means so that the toner in a minimum required amount is supplied optimally to the surface of the toner holding member. This obviates the necessity to provide the coating means for coating the toner onto the toner holding member by using a mechanical coating force or a bias voltage, which has been described above in association with the prior art technology.

The charge adjusting means is interposed between the toner supplying means and the development region in which the toner holding member and the surface of the electrostatic latent image holding member for holding the electrostatic latent image are in contact with or spaced apart from each other to render the electrostatic latent image visible as a toner image. The arrangement reduces the amount of charge of the toner in the development region compared with the period during which the toner is transported. Accordingly, the specific charge of the toner can be reduced. Even when a toner having a small particle diameter is used, it becomes possible to increase the amount of the toner supplied to the electrostatic latent image in the development region, increase the amount of the toner consumed in the development region, prevent a reduction in image density, prevent a so-called fog at a non-image portion, and achieve an optimum image density.

In accordance with the invention, the toner is supplied and transported by the toner holding member toward the development region with a large amount of charge, while the amount of charge is reduced by the charge adjusting means in the development region to lower charge, whereby the amount of the toner supplied to the electrostatic latent image is increased and an optimum image density is achieved.

In the invention it is preferable that the charge adjusting means is a frictional charging member which has a same charging polarity as that of the toner to be charged, and is formed of a material more likely to be charged to have the polarity than the toner.

In accordance with the invention, the frictional charging member formed of a material charged as the charge adjusting means is used to absorb the charge of the toner. Such a structure is simple and capable of adjusting the amount of charge absorbed from the toner by selecting the material of the frictional charging member, thereby providing optimum development quality. The frictional charging member may be formed to cover a surface of a flat plate portion of, e.g., a conductive plate-like member having elasticity such as a plate spring such that the frictional member is elastically pressed against a surface of the toner holding member.

In accordance with the invention, since the frictional charging member is used as the charge adjusting means, it can be practiced easily because of its simple structure.

In the invention it is preferable that the charge adjusting means includes:

a conductive member to be brought into contact with a tone layer on the toner holding member; and a voltage source connected to the conductive member, for supplying to the conductive member, such a potential as to decrease the charge of the toner.

In accordance with the invention, the conductive member implemented by a metal plate-like member composing the charge adjusting means is brought into contact with the toner layer on the surface of the toner holding member, the voltage source is connected to the conductive member, and a bias potential is set to, e.g., 0 V or to a value of the polarity opposite to the charging polarity of the toner, whereby the charge of the toner is decreased. Such a conductive member may also be a roller configured as a right cylinder and having at least a surface made of metal such that the axis of the roller extends in parallel with the rotation axis of the toner supplying means in a plane.

In accordance with the invention, the charge adjusting means is implemented by the plate-like member or metal roll. The invention can also be practiced with such a relatively simple structure.

The invention also provides an electrophotographic apparatus comprising the electrophotographic developing apparatus mentioned above.

In the electrophotographic apparatus of the invention, the amount of charge of the toner is increased during the transportation of the toner and reduced in the development region compared with that during the transportation. The arrangement allows the toner to be electrostatically attracted to the surface of the toner holding member through the supply and transportation of the toner. Since the amount of charge of the toner is reduced in the development region compared with that during the transportation, the specific charge is reduced. As a result, there can be implemented an electrophotographic apparatus capable of providing a sufficient image density and improved development quality even by using a toner having a small particle diameter.

In accordance with the invention, an electrophotographic image forming apparatus can be implemented by using one of the three electrophotographic developing apparatuses and improved development quality is provided.

The invention also provides an electrophotographic apparatus comprising:

an electrostatic latent image holding member for holding an electrophotographic latent image on a surface thereof; and a toner holding member for electrostatically attracting a toner to rotate and rendering the electrostatic latent image visible with the toner, the surface of the electrostatic latent image holding member having a same polarity as the charging polarity of the toner and being formed of a material more likely to be charged than the toner so that the surface removes excess charge from the toner when the surface comes into contact with the toner.

In accordance with the invention, the electrophotographic apparatus has the electrostatic latent image holding member and the toner holding member for holding the toner on the surface thereof. The surface layer of the electrostatic latent image holding member has the same polarity as the charging polarity of the toner and is formed of the material more likely to be charged than the toner. The surface of the electrostatic latent image holding member removes excess charge from the toner for ease when the electrostatic latent image on the electrostatic latent image holding member comes into contact with the toner. This allows the amount of charge of the toner to be increased during the transportation of the toner and reduced in the development region compared with the amount of charge during the transportation. As a result, it becomes possible to ensure the electrostatic attraction of the toner to the toner holding member and provide improved development quality by reducing the specific charge.

In accordance with the invention, the surface layer of the electrostatic latent image holding member has substantially the same polarity as the charging polarity of the toner and is formed of the material more likely to be charged than the toner. The arrangement allows the amount of charge of the toner to be reduced in the development region compared with that during the transportation, thereby providing improved development quality.

The invention also provides an electrophotographic apparatus comprising:

an electrostatic latent image holding member composed of a translucent conductive layer and a photoconductive layer, which are formed in this order on a light-transmitting base, the photoconductive layer having a same polarity as a charging polarity of the toner, and containing a material more likely to be charged than the toner, the electrostatic latent image holding member being rotated;

charging means for charging the electrostatic latent image holding member;

exposing means for forming an electrostatic latent image by exposing, in an exposure region, the photoconductive layer from the base side downstream from the charging means in the direction of rotation; and a toner holding member for electrostatically attracting the toner to rotate and rendering the electrostatic latent image visible with the toner at least in the exposure region or over the exposure region and a region located downstream thereof across the boundary therebetween.

In accordance with the invention, the photoconductive layer of the electrostatic latent image holding member is uniformly charged by the charging means to have a surface charge density $-\sigma$. Since the photoconductive layer has the same polarity as the charging polarity of the toner and contains the material more likely to be charged than the toner, the photoconductive layer deprives the toner of a part $-\Delta q$ of the charge thereof. The toner holding member supplies the toner to the exposure region or to the exposure region and a region located upstream thereof across the boundary therebetween so that the toner adheres to the portion of the exposure region irradiated with a light beam and the charge has disappeared to provide a visible image. Alternatively, the toner holding member may also be so constructed as to cause the toner to adhere to the exposure region and a region located downstream thereof across the boundary thereof. Thus, the toner is transported with a high specific charge and the specific charge of the toner is adjusted in the exposure region, i.e., in the development region, while an electrostatic latent image is formed and the toner having a specific charge adjusted adheres selectively to the electrostatic latent image, so that a visible image is provided. The exposing means performs exposure by irradiating, from the innermost translucent base side, the photoconductive layer formed on the outermost circumferential surface of the electrostatic latent image holding member with a light beam from a light-emitting diode array or the like, thereby forming an electrostatic latent image on the photoconductive layer. The portion of the photoconductive layer to which the toner should adhere is irradiated with the light beam. The portion irradiated with the light beam becomes conductive and the charge of the portion irradiated with the light beam is removed to disappear via the translucent conductive layer interior to the photoconductive layer. The base of the electrostatic latent image holding member and the conductive layer are translucent and may be, e.g., transparent.

In accordance with the invention, the photoconductive layer is exposed through the translucent base and the translucent conductive layer and the specific charge of the toner transported with a high specific charge is adjusted in the exposure region, while an electrostatic latent image is formed and development is performed by causing the toner to adhere to the electrostatic latent image in the exposure region or in a region located downstream thereof in the direction of rotating movement of the electrostatic latent image holding member. As a result, there is implemented an electrophotographic apparatus capable of providing improved development quality.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
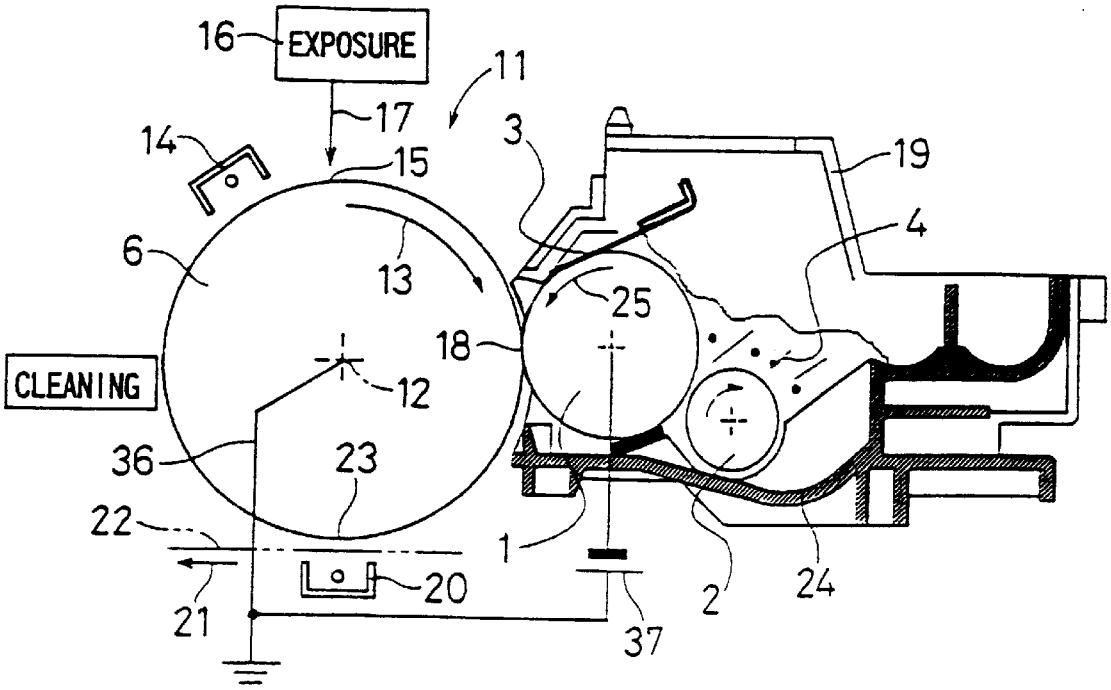
FIG. 1 is a schematic cross-sectional view of an electrophotographic apparatus 11 according to an embodiment of the invention.

Now referring to the drawings, preferred embodiments of the invention are described below.

FIG. 1 is a schematic cross-sectional view of an electrophotographic apparatus 11 according to an embodiment of the present invention. An electrostatic latent image holding member 6 which is a right cylindrical photosensitive drum has a horizontal axis 12 and is rotatively driven in a direction 13 of rotation. The electrostatic latent image holding member 6 is charged by a primary discharger 14 through corona discharging and irradiated, in the direction of the axis 12, with a light beam 17 such as a laser beam from exposing means 16 in an exposure region 15, whereby an electrostatic latent image is formed on a surface thereof. In a development region 18, the electrostatic latent image is rendered visible as a toner image by the action of the electrophotographic developing apparatus 19. The toner image is transferred in a transfer region 23 onto a recording sheet 22 transported in a direction 21 of transportation between the electrostatic latent image holding member 6 and a transfer charger 20. The recording sheet 22 with the transferred toner image is guided to, e.g., a thermal fixing device where the toner is thermally melted and fixed. By such a sequential electrophotographic process, an image is formed on the recording sheet 22. The exposing means 16 may be, e.g., a laser light source or may be implemented by a light-emitting diode (LED) array. In a copier, the exposing means 16 may be an optical system for forming an original document image on the exposure region 15.

A toner 4 is a one-component non-magnetic toner. In a casing 24 of the electrophotographic developing apparatus 19, there are provided a toner holding member 1 configured as a substantially right cylinder and toner supplying means 2 for supplying and transporting the toner 4 reserved in the casing 24 to a surface of the toner holding member 1. The toner holding member 1 is made of such a material as elastic urethane rubber containing, e.g., carbon. The surface of the toner holding member 1 is elastically pressed against a surface of the electrostatic latent image holding member 6 in the development region 18. According to another embodiment of the present invention, a space may be present between the surface of the toner holding member 1 and the electrostatic latent image holding member 6 in the development region 18. The toner holding member 1 has a substantially right cylindrical outer configuration. The toner holding member 1 rotates in a direction 25 of rotation to have the surface brought into contact with the toner 4 such that the toner 4 is frictionally charged. The charged toner is electrostatically attracted to the surface of the toner holding member 1 to cause the rotation thereof, whereby the toner 4 is supplied and transported to the development region 18.

Figure 2:
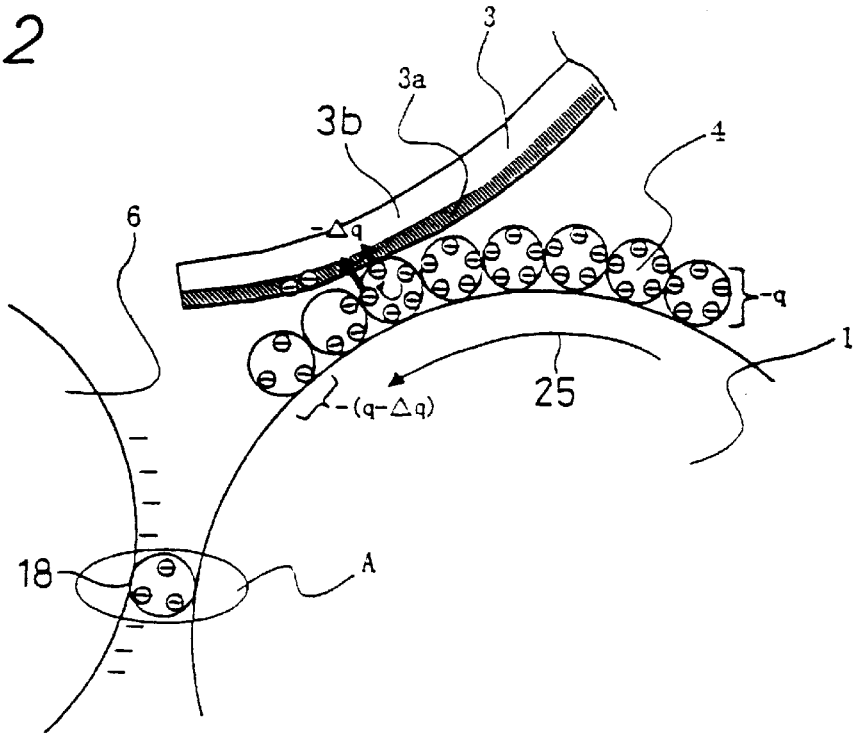
FIG. 2 is a partially enlarged cross-sectional view of the vicinity of a development region 18 according to the embodiment shown in FIG. 1.

FIG. 2 is a partially enlarged cross-sectional view of the vicinity of the development region 18 in the embodiment shown in FIG. 1. The toner 4 is supplied by the toner supplying means 2 onto the toner holding member 1 to acquire a negative charge −q upon contact with the toner holding member 1 through frictional charging. As shown in FIG. 2, the toner 4 formed on the toner holding member 1 is transported with the rotation of the toner holding member 1 to come into contact with charge adjusting means 3. The charge adjusting means 3 is formed by using, as a base 3*b*, a flat plate made of brass or stainless steel and having a thickness of about 0.1 to 0.2 mm and has a frictional charging member 3*a* made of Cerazol, a fluorine-based synthetic resin, or a synthetic resin such as polyimide provided on the surface thereof opposed to the toner holding member 1. The frictional charging member 3*a* made of Cerazol or polyimide is formed by coating a surface of the base 3*b* of the charge adjusting means 3 or affixing a film-like material thereto. Cerazol and polyimide are materials which are inherently likely to be charged negatively and deprive the toner 4 of the negative charge $-\Delta q$. As a result, the toner 4 has a charge of $-(q-\Delta q)$.

Subsequently, the toner 4 is transported to a development station A adjacent the development region 18 and developed at the image portion of the electrostatic latent image holding member 6, i.e., the portion which has lost the negative charge upon exposure. Since the development process is performed by decreasing the potential of the latent image with the charge of the toner 4, the amount of toner for decreasing the potential of the latent image increases as the specific charge (charge per unit weight of the toner) is lower. By adjusting the specific charge of the toner by means of the charge adjusting member 3, therefore, a desired amount of development can be obtained. The electrostatic latent image holding member 6 is grounded, as indicated by a reference numeral 36. The toner holding member 1 receives a bias corresponding to a DC voltage represented by a power source 37 relative to the ground potential to be held at a low potential so that an improved image quality is achieved.

The embodiment of the present invention will be further described with reference to the result of an experiment conducted by the present inventors. In the structure of FIG. 1, negatively charged small-particle-diameter toners having respective mean particle diameters of 5 μm and 7 μm are used.

Figure 3:
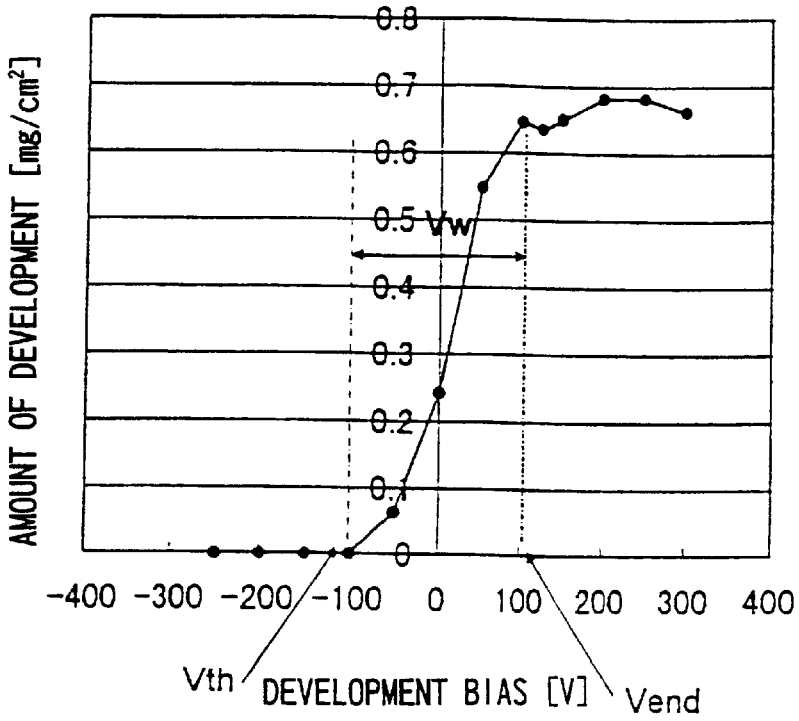
FIG. 3 is a graph showing a development characteristic when a toner having a 7-$\mu$m particle diameter is used.

FIG. 3 is a graph showing a development characteristic in the case of using the toner 4 having a 7-μm particle diameter. In FIG. 3, a development bias at the initiation of development is represented by Vth, a development bias when the amount of development is saturated is represented by Vend, and the width of a development bias is represented by Vw=Vend−Vth. The development bias is a potential difference between the potential of a latent image and the potential of the toner holding member 1. A mean specific charge of the toner 4 having a 7-μm particle diameter on the toner holding member 1 is −25 to −30 μC/g.

Figure 4:
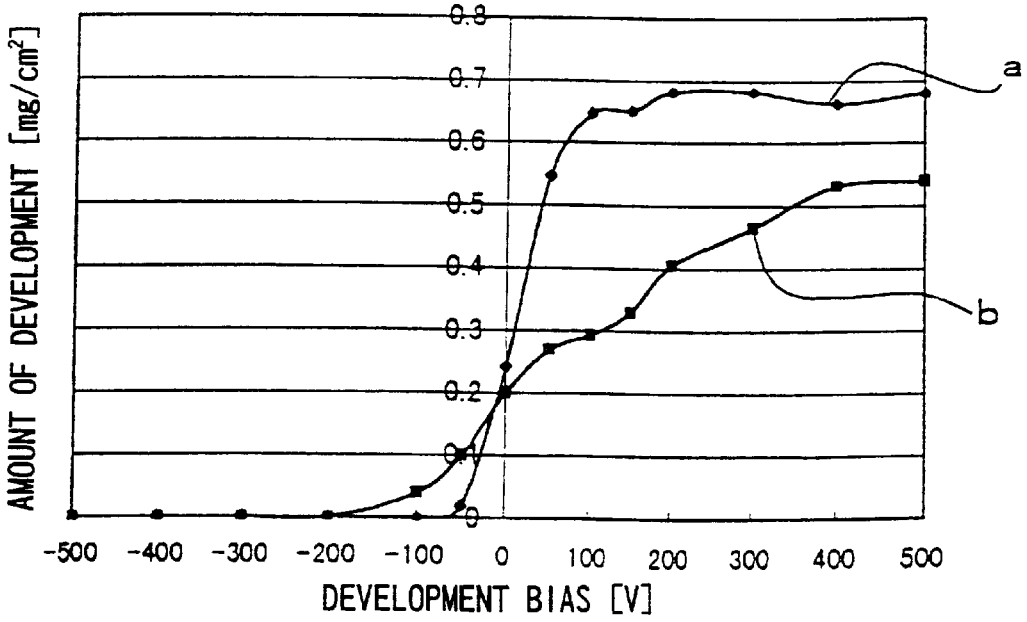
FIG. 4 is a graph showing, for comparison, the development characteristic a of the toner having a particle diameter of 7 $\mu$m and the development characteristic b of a toner having a 5-$\mu$m particle diameter.

FIG. 4 is a graph showing, for comparison, the development characteristic a of the toner 4 having a 7-μm particle diameter and the development characteristic b of the toner having a 5-μm particle diameter. When frictional charging is caused in the developing apparatus of FIG. 1, the mean specific charge of the toner having a 5-μm particle diameter on the toner holding member 1 is −45 to −50 μC/g. As shown in FIG. 4, the development voltage width Vw of the toner having a 5-μm particle diameter and a high specific charge is 450 V to 500 V, while the development voltage width Vw of the toner 4 having a 7-μm particle diameter and a low specific charge is 150 V to 200 V. Thus, it has been proved that developability lowers and a voltage required for development increases when the toner with a high specific charge is used.

In an electrophotographic process, the charging potential of a photosensitive member on the surface of the electrostatic latent image holding member 6 is 1 kV at the maximum when the thickness of a photosensitive member is 20 μm and 500 V when the thickness is 10 μm in terms of voltage resistance. As the thickness of the photosensitive member is smaller, resolution is higher but charging potential is lower so that it is necessary to perform development with a minimum possible development voltage.

Figure 5:
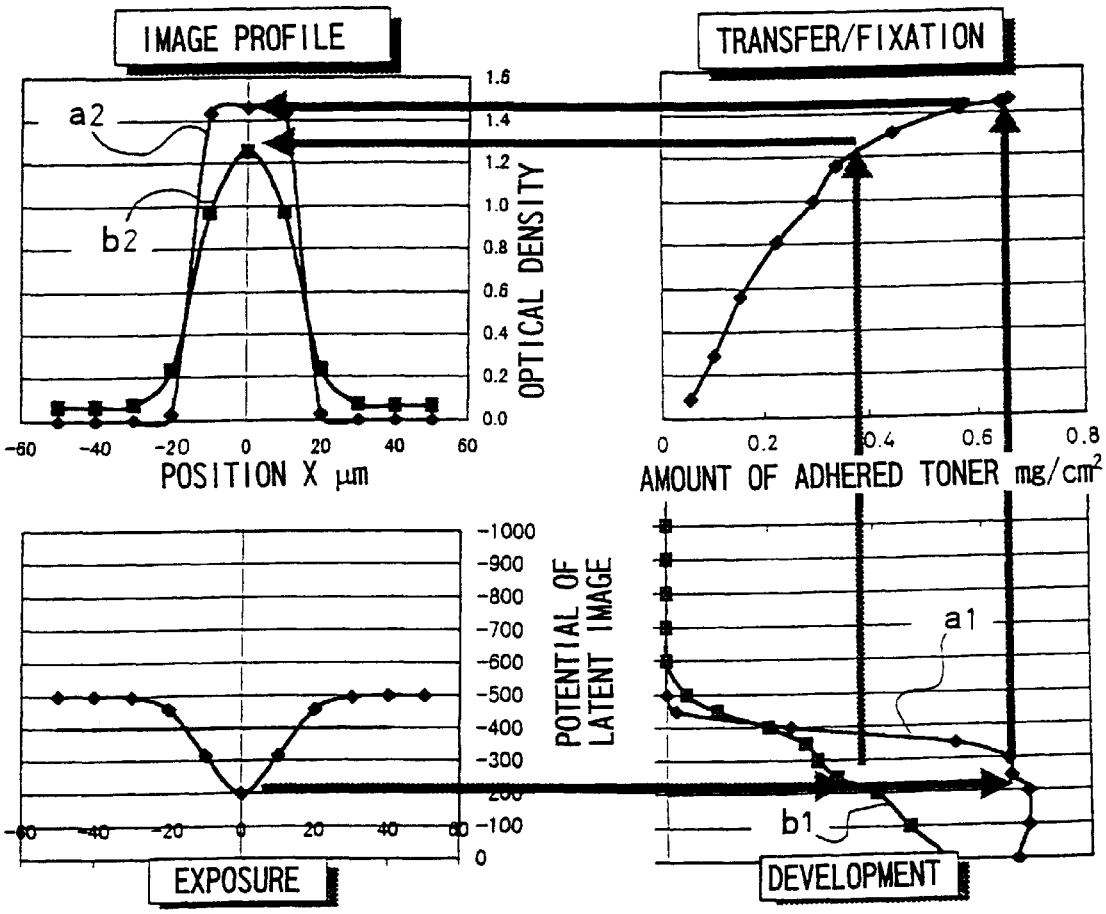
FIG. 5 is a view showing the transmission characteristics of the toners when images are formed by an electrophotographic process, which are obtained as a result of an experiment conducted by the present inventors.

FIG. 5 is a view showing the transmission characteristics of the toners when images are formed by an electrophotographic process, which is obtained as a result of an experiment conducted by the present inventors. Images were formed by the electrophotographic process using a toner a1 having a specific charge of −25 to −30 μC/g and a toner b1 having a specific charge of −45 to −50 μC/g. In the exposure process of FIG. 5, the photosensitive member used had a thickness of 10 μm and the charging potential was −500 V (at a non-image portion) so that a potential at the image portion becomes −200 V after exposure using an optical spot of ϕ40 μm When the toner a 1 having a proper specific charge is used, an image profile a2 is obtained and the resulting image has an excellently sharp edge. When the toner b1 having an excessively high specific charge is used, a fog occurs at the non-image portion and image density lowers, resulting in an image with a degraded S/N ratio, as shown in the image profile b2. consequently, the developability of the toner having a small particle diameter and a high specific charge of −45 to −50 μC/g is lowered and a thin-film photosensitive member for which high resolution is particularly expected will lose image sharpness. The foregoing result has proved that, to provide a sufficient amount of development and sufficient image sharpness, a specific charge of −40 μC/g or less, preferably in the range of −25 to −30 μC/g, is appropriate. Although the present embodiment has described the difference between the development characteristics of the toners a1 and b1 having different particle diameters, toners having equal specific charges exhibit equal development characteristics.

A description will be given to the result of an experiment conducted by the present inventors on the specific charge of the toner and toner supply start-up performance. In the structure of FIG. 1, the number of rotations of the toner holding member 1 required by the surface potential of the toner layer on the toner holding member 1 to be saturated was examined under such conditions that the diameter of the toner holding member 1 was 32 mm and a rotation frequency was 106 rpm. As a result of conducting experiments using several toners having different specific charges, the surface potential of the toner layer was saturated in four to five rotations (i.e., rotation frequency) with an amount of charge corresponding to a specific charge of −10 to −15 μC/g, in three rotations with a specific charge of −15 to −20 μC/g, within one rotation with a specific charge of −30 μC/g or more and it was proved that the supply start-up performance is higher as the specific charge is higher. It was also proved that, to complete the supply of the toner within one rotation of the toner holding member 1 with the toner holding member 1 and the supply member 2 held in a non-contact state, the specific charge of the toner should be −30 μC/g or more.

From the foregoing results, it can be concluded that a specific charge of −30 μC/g or more is required to transport the toner and a specific charge of −40 μC/g or less, preferably in the range of −25 to −30 μC/g, is proper for a sufficient amount of development. A specific charge which satisfies the two requirements exists only in the narrow range of −30 to −40 μC/g so that control of the amount of charge becomes extremely difficult. In particular, a toner having a small particle diameter and a high specific charge has no value that satisfies the two requirements.

To solve the foregoing problem and allow the use of various toners, therefore, the present invention provides a Cerazol film (with a thickness of 25 μm) having a strongly negative charging polarity on the frictional charging member 3*a* of the charge adjusting means 3 when a negatively charged toner is used in the developing apparatus 11 of FIGS. 1 and 2. This reduces the specific charge of the toner of the negative polarity by about 30% so that the toner having a specific value of −50 $\mu$C/g at a transport station has a specific charge of −35 $\mu$C/g at a development station A. At that time, an image profile was obtained and it was experimentally proved by the present inventors that a non-image portion was free of a fog and a sharp image was obtainable.

Although the description has been given to the case where the negatively charged toner is used in the embodiment of FIGS. 1 and 2, a member more likely to be charged positively than the non-magnetic toner 4 may be used properly for the charge adjusting means 3 when a positively charged toner is used in another embodiment of the present invention. Specifically, such a material as nylon or PVA (polyvinyl alcohol) is usable for the frictional charging member 3*a*. It follows that the charge adjusting means 3 deprives the positively charged toner having a charge q of a positive charge $\Delta q$ and the toner will have an amount $(q-\Delta q)$ of charge at the development station A.

Figure 6:
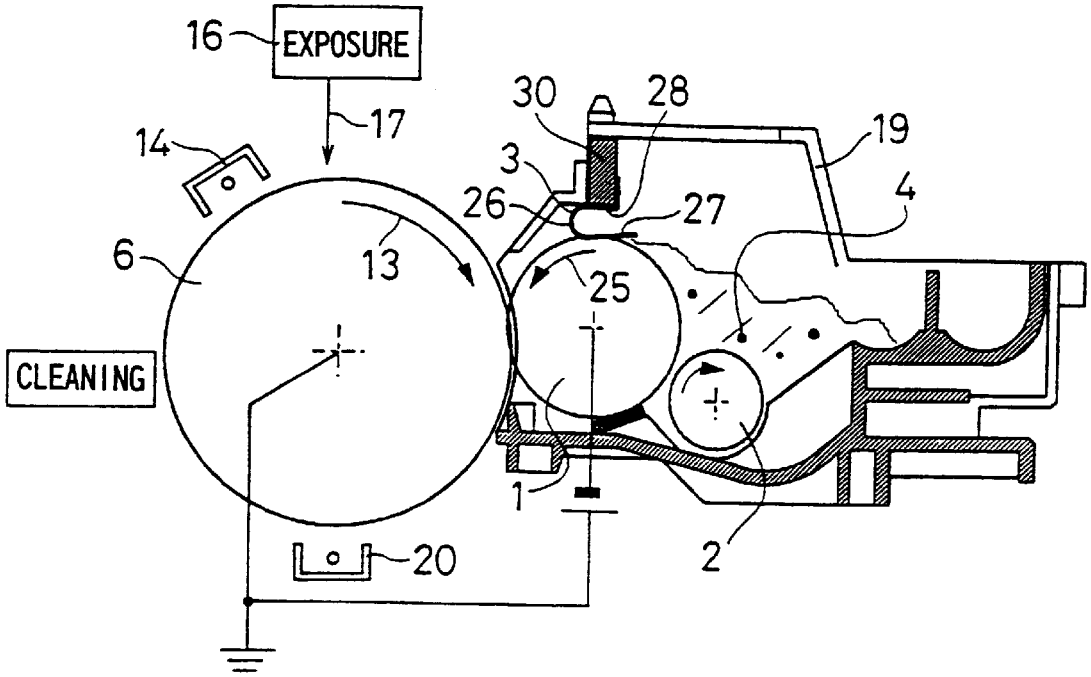
FIG. 6 is a cross-sectional view of a developing apparatus according to another embodiment of the present invention.

FIG. 6 is a cross-sectional view of a developing apparatus according to another embodiment of the present invention. The embodiment is similar to the above-described embodiment of FIGS. 1 to 5 so that the corresponding components are denoted by the same reference numerals. In the charge adjusting means 3, the frictional charging member 3*a* is provided on a surface of the base 3*b* which is an arcuate plate spring. The base 3*b* which is the arcuate plate spring is composed of a brass flat plate with a thickness of about 0.2 mm, which is formed into a configuration consisting of an arcuate section 26 with a radius of 2.6 mm and a flat plate section 27 with a length of 14 mm at a free end side. A proximal end 28 is fixed to an upper inner wall 30 of the developing apparatus 19. By using the base 3*b* of the arcuate plate spring as a part of the charge adjusting means 3, the spring constant of the arcuate plate spring elastically pressed against the toner holding member 1 can be reduced compared with that of the plate spring composed only of a flat plate of FIGS. 1 and 2, so that a wide nip is provided with a smaller contact pressure. As a result, the thickness of the toner layer can be regulated and charge can be adjusted by using the charge adjusting means as a single member so that, even when the toner holding member 1 performs rotation involving eccentricity, a pressure variation upon contact is small. This enables charge adjustment highly resistant to a mechanical variation when charge adjustment is performed with frictional charging.

Figure 7:
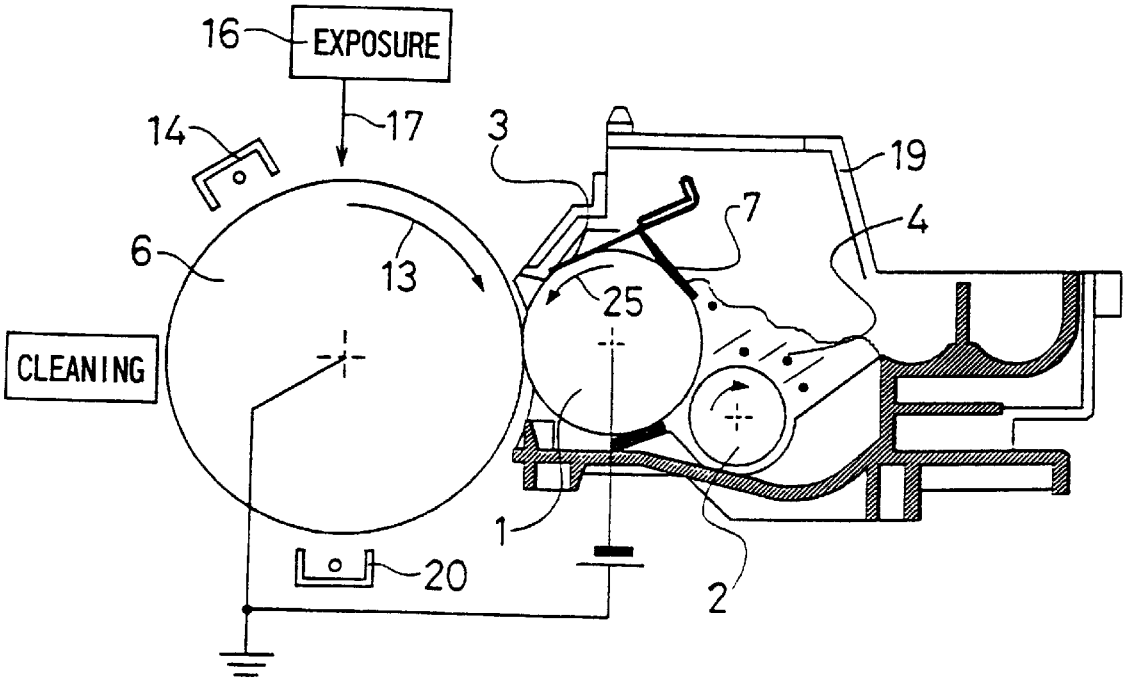
FIG. 7 is a cross-sectional view of a developing apparatus according to still another embodiment of the present invention.

FIG. 7 is a cross-sectional view of a developing apparatus according to still another embodiment of the present invention. The embodiment is similar to the above-described embodiment so that the corresponding components are denoted by the same reference numerals. In contrast to the embodiments of FIGS. 1 to 6 which have been so constructed as to use a single member to adjust the charge of the toner and regulate the toner layer, a toner layer regulating member 7 is provided upstream of the charge adjusting means 3 in the present developing apparatus. By newly providing the toner layer regulating member 7, it becomes possible to separately perform the regulation of the toner layer and charge adjustment. The present developing apparatus is suitable for the case where a thinner toner layer is formed or the thickness of the toner layer is controlled. The present invention can also be practiced in yet another embodiment which is constructed such that the toner layer regulating member 7 is provided downstream of the charge adjusting member 3.

Figure 8:
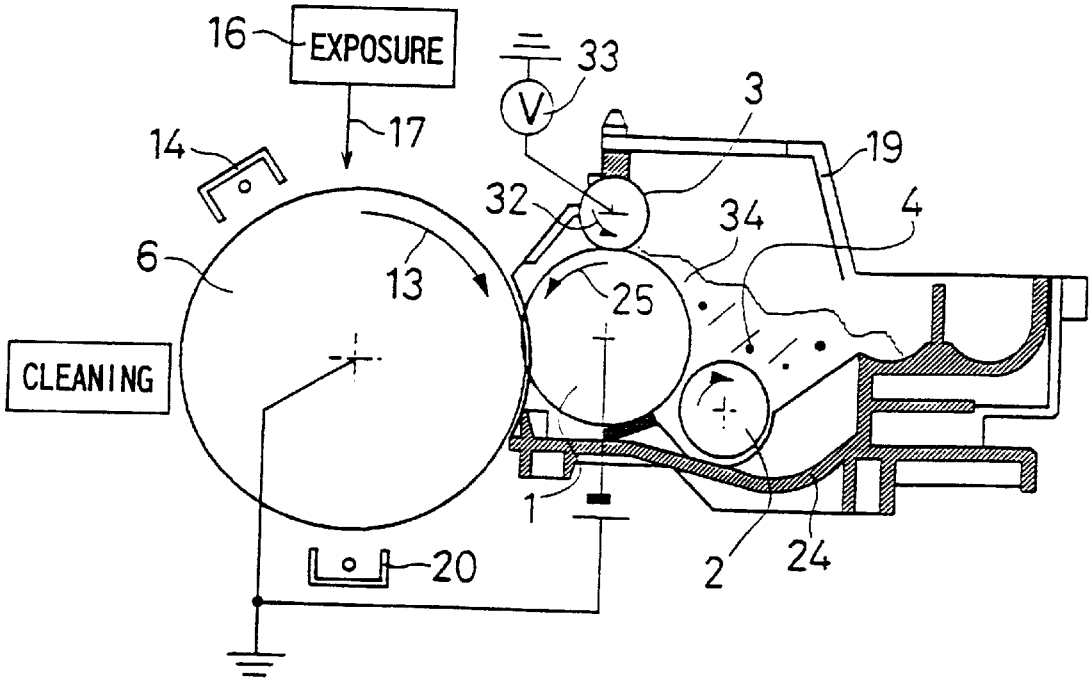
FIG. 8 is a cross-sectional view of a developing apparatus according to yet another embodiment of the present invention.

FIG. 8 is a cross-sectional view of a developing apparatus according to still another embodiment of the present invention. The present embodiment is similar to the above-described embodiments. In the present embodiment, a grounded conductive roller is used as the charge adjusting means 3. Hereinafter, the conductive roller may be designated by a reference numeral 3. The toner holding member 1 is composed of a conductive urethane rubber roller of $\phi$32 mm containing carbon. The conductive roller 3 has a diameter of $\phi$16 mm and is made of a metal such as stainless steel SUS416. A linear pressure applied to the conductive roller 3 is 100 gf/cm. A direction 32 of rotation of the conductive roller 3 is the same (counterclockwise) as the direction 25 of rotation of the toner holding member 1 and the ratio of the circumferential speed of the conductive roller 3 to that of the toner holding member 1 is set to 0.15.

Figure 9:
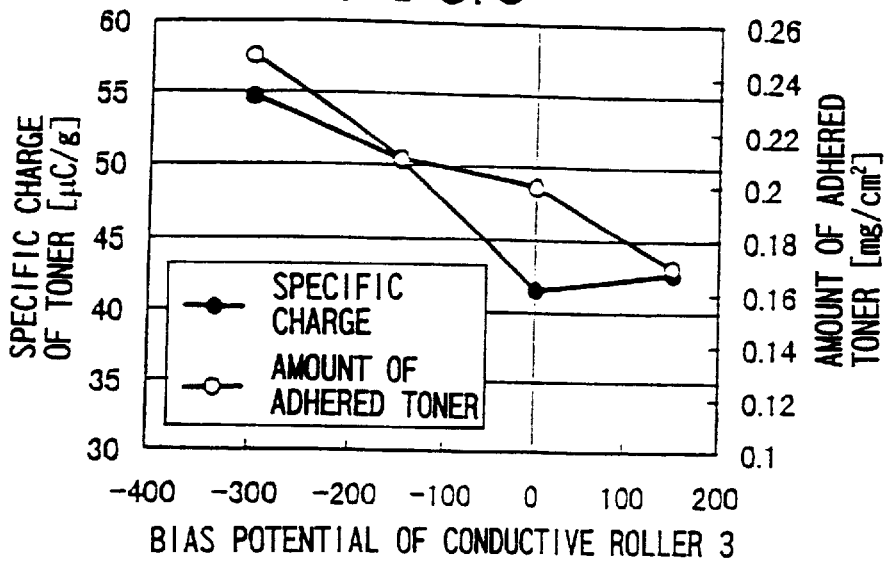
FIG. 9 is a view showing the relations among a bias potential at a conductive roller 3 of FIG. 8, the specific charge of the toner, and the amount of adhered toner, which are obtained as a result of the experiment conducted by the present inventors.

A one-component non-magnetic negatively charged toner 4 having a mean particle diameter of 5 $\mu$m was placed in the casing 24 of the developing apparatus 19. Then, the conductive roller 3 is connected to a voltage source 33 and the magnitude of the specific charge of the toner on the toner holding member 1 and the amount of the toner adhered thereto were examined by varying a bias potential. As a result, the specific charge of the toner was reduced when the bias potential to the conductive roller 3 is 0 V or more, as shown in FIG. 9. When a bias of the polarity opposite to the charging polarity of the toner, i.e., a positive bias was applied to the conductive roller 3, the amount of the toner adhered onto the toner holding member 1 was reduced significantly and optimum when the potential of the conductive roller 3 was 0 V. By thus providing the conductive roller 3 as the charge adjusting means 3 upstream of the development station A and downstream of the supply station 34 and adjusting the bias potential applied to the conductive roller 3 to 0 V or higher, the specific charge accumulated in the non-magnetic toner 4 can be reduced and adjusted to a proper value at the development station A. Although the present embodiment has used the charge adjusting means 3 configured as a roller, the configuration of the charge adjusting means 3 is not limited to a roller and other configurations can be used so long as the charge adjusting means is composed of a conductive member.

Figure 10:
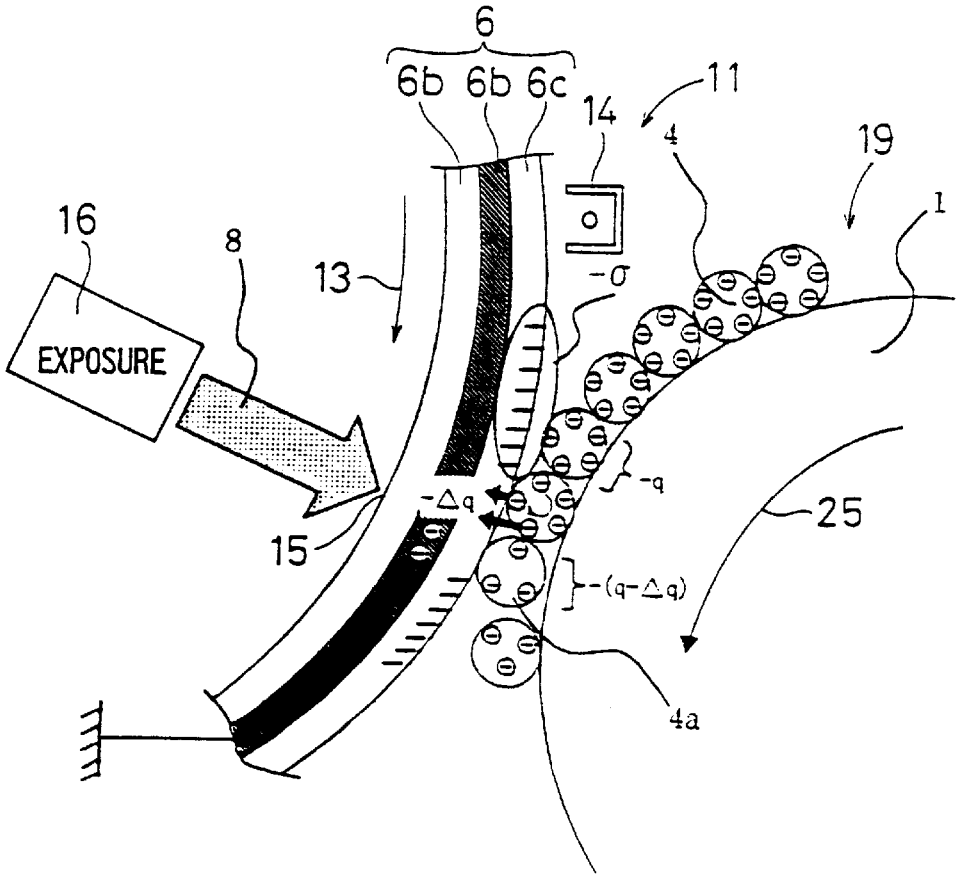
FIG. 10 is a partially enlarged cross-sectional view of a developing apparatus 19 of an electrophotographic apparatus 11 according to still another embodiment of the present invention.

FIG. 10 is a partially enlarged cross-sectional view of the developing apparatus 19 of the electrophotographic apparatus 11 according to yet another embodiment of the present invention. The present embodiment is similar to the above-described embodiments and the corresponding components are denoted by the same reference numerals. In the present embodiment, in particular, the electrostatic latent image holding member 6 is configured as a right cylinder and the charge adjusting means is the electrostatic latent image holding member 6 itself. The surface layer of the electrostatic latent image holding member 6 is a photoconductive film 6*c* having the same polarity as the charging polarity of the toner and containing a material more likely to be charged to have the polarity than the toner. When the toner is of the negative polarity, a polyimide or a fluorine-based synthetic resin is preferably used.

A description will be given to the mechanism of charge adjustment. The non-magnetic toner 4 held on the toner holding member 1 is held and transported with a high specific charge −q. Of the photoconductive film 6*c*, a portion irradiated with a light beam becomes conductive, while the portion thereof unirradiated with the light beam remains electrically insulating. When the toner 4 comes into contact with the surface of the photoconductive film 6*c*, the toner 4 is deprived of the negative charge $-\Delta q$ by the photoconductive film 6*c* so that the charge $-(q-\Delta q)$ remains in the toner. The surface of the photoconductive film 6*c* in contact with the toner 4 holds the charge $-\Delta q$ obtained from the toner in addition to the surface charge which is $-\sigma$ per unit area resulting from the precharging of the entire surface by the charger 14. The layer on the back surface of the photoconductive film 6*c* is provided with a transparent conductive film 6*b* and a transparent base 6*a*. Backside exposure is performed by irradiating, in the exposure region 15, a portion to which the toner 4 should adhere with a light beam 8 from the exposing means 16 such as a light-emitting diode provided within the electrostatic latent image holding member 6. The irradiated light beam penetrates the transparent base 6*a* and the transparent conductive film 6*b* to reach the photoconductive film 6*c*. By an exposing operation entailing an exposed area S, each of the surface charge $-\sigma \cdot S$ and the charge $-\Delta q$ obtained from the toner 4 disappears from the grounded transparent conductive film 6*b*. In this manner, the toner 4*a* having the properly adjusted charge $-(q-\Delta q)$ adheres to the portion of the photoconductive film 6*c* that has lost charge and is developed in the exposure region 15 or in a region located downstream thereof.

In the case of using the electrostatic latent image holding member 6 as the charge adjusting means, the operation of dissipating the surplus charge $-\Delta q$ obtained upon contact with the toner 4 is important. This is because development is the operation of compensating for the charge lost upon exposure and, if the charge $-\Delta q$ remains, the amount of charge to be compensated for is reduced, i.e., the amount of development is reduced. To dissipate, in the development region, the surplus charge $-\Delta q$ obtained upon contact between the toner 4 and the electrostatic latent image holding member 6, backside exposure is more effective. By imparting a charge adjusting function to the electrostatic latent image holding member 6 which performs backside exposure as described above, the toner 4 is transported with a high specific charge and the adjustment of the specific charge of the toner and the formation of the latent image can be performed simultaneously in the development region, which renders transportability and developability compatible with each other.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrographic developing apparatus comprising:

a toner holding member for frictionally contacting a toner so as to charge and electrostatically attract the toner to rotate and render, in a development region, an electrostatic latent image held on a surface of an electrostatic latent image holding member visible using the toner;

toner supplying means for supplying the toner to the toner holding member; and charge adjusting means disposed between the development region and the toner supplying means for decreasing the amount of charge on the toner, wherein after the charging of the toner by contact with the toner holding member, the amount of charge on the toner is decreased by the charge adjusting means.

2. An electrophotographic image developing apparatus comprising:

a supply of toner;

an electrostatic latent image holding member having an endless outer photosensitive layer disposed in electrical contact with a grounded inner conductive member, said photosensitive layer being formed at least partially of particles having a high affinity for one type of charge and adapted for forming a latent image in response to selective exposure to light and for movement past a development region, and said grounded inner conductive member being adapted to maintain a preselected charge level in said photosensitive layer;

a toner holding member including an endless transfer surface, wherein said toner holding member is adapted to attract and hold a substantially continuous layer of said toner having a first specific charge on said transfer surface at said supply, and to move said layer of said toner to said development region in close or touching relation to said photosensitive layer of said electrostatic latent image holding member; and, charge adjustment means for decreasing said first specific charge of the toner on said transfer surface to a second, lower, specific charge as, or substantially immediately before, said layer of toner is delivered to said development region by said toner holding member;

whereby toner having said first specific charge is transferred from said supply to, or substantially immediately adjacent to, said development region, and a latent image formed on said latent image holding member is visualized in said development region using toner having said second specific charge.

3. The electrophotographic image developing apparatus of claim 2, wherein the charge adjusting means is a frictional charging member which has the same charging polarity as the first specific charge on the toner, and is formed of a material having a greater affinity for that polarity of charge than the toner.

4. The electrophotographic image developing apparatus of claim 2, wherein the charge adjusting means includes:

a conductive member adapted to be brought into contact with the toner layer on the surface of the toner holding member; and a voltage source connected to the conductive member for supplying to the conductive member a potential adapted to reduce the first specific charge on the toner layer to the second, lower, specific charge.

5. An electrophotographic apparatus comprising the electrophotographic image developing apparatus of any one of claims 2 to 4.

6. An electrophotgraphic apparatus comprising:

a grounded electrostatic latent image holding member for receiving and holding an electrophotographic latent image thereon; and a toner holding member for electrostatically attracting toner to rotate and rendering the electrostatic image visible with the toner;

wherein a surface of the electrostatic latent image holding member has the same polarity as the charging polarity of the toner by virtue of being formed of a material having a greater affinity for the polarity of charge than the toner such that the electrostatic latent image holding member tends to remove excess charge from the toner when the surface comes into contact with the toner and to thereafter dissipate the excess charge so removed.

7. An electrophotographic apparatus comprising:

an electrostatic latent image holding member composed of an inner, grounded, translucent conductive member and an outer photoconductive layer, said inner and outer layers being formed in this order and in direct electrical contact with one another on a light-transmitting base, said photoconductive layer having the same polarity as a charging polarity of a toner, and having a greater affinity for that polarity than the toner;

the electrostatic latent image holding member being adapted to rotate in a preselected direction;

charging means for charging the electrostatic latent image holding member;

exposing means for forming an electrostatic latent image by exposing in an exposing region the photoconductive layer from the base side downstream of the charging means in the direction of rotation of said electrostatic latent image holding member; and a toner holding member for electrostatically attracting the toner to rotate and rendering the electrostatic latent image visible with the toner at least in the exposure region or over the exposure region and a region located downstream thereof across the boundary therebetween.

* * * * *